United States Patent [19]

Suzaki et al.

[11] Patent Number: 4,723,853

[45] Date of Patent: Feb. 9, 1988

[54] THERMAL TRANSFER PRINTER

[75] Inventors: Masafumi Suzaki, Hitachi; Katsumasa Mikami, Naka; Yoosuke Nagano; Tomoji Kitagishi, both of Hitachi; Akira Sasaki; Kunio Tajima, both of Hitachi, all of Japan

[73] Assignee: Hitachi, Ltd., Tokyo, Japan

[21] Appl. No.: 931,040

[22] Filed: Nov. 17, 1986

Related U.S. Application Data

[63] Continuation of Ser. No. 728,042, Apr. 29, 1985.

[30] Foreign Application Priority Data

May 8, 1984 [JP] Japan ..... 59-91409

[51] Int. Cl.[4] ..... B41J 3/20; B41J 33/40; B41J 19/56

[52] U.S. Cl. ..... 400/120; 400/222; 400/233; 400/322; 400/331.3; 400/334.1; 400/335; 74/125.5; 74/141.5

[58] Field of Search ..... 400/120, 222, 236.2, 400/331.3, 334.1, 569, 320, 322, 335, 233; 74/125.5, 141.5, 142, 159

[56] References Cited

U.S. PATENT DOCUMENTS

| | | | |
|---|---|---|---|
| 3,358,518 | 12/1967 | Patterson | 400/331.3 |
| 3,799,305 | 3/1974 | Limberger | 74/125.5 X |
| 4,030,588 | 6/1977 | Hanagata et al. | 400/120 X |
| 4,173,273 | 11/1979 | Hanakata | 400/320 X |
| 4,186,611 | 2/1980 | McKnight | 74/142 X |
| 4,350,987 | 9/1982 | Hanagata et al. | 400/120 X |
| 4,408,908 | 10/1983 | Applegate et al. | 400/120 |
| 4,461,588 | 7/1984 | Watanabe et al. | 400/320 X |
| 4,500,892 | 2/1985 | Hirano | 400/320 X |

FOREIGN PATENT DOCUMENTS

| | | | |
|---|---|---|---|
| 106683 | 4/1984 | European Pat. Off. | 400/120 X |
| 2022633 | 11/1970 | Fed. Rep. of Germany | 400/120 X |
| 3301312 | 7/1983 | Fed. Rep. of Germany | 400/320 |
| 2494186 | 5/1982 | France | 400/120 X |
| 116247 | 10/1979 | Japan | 400/120 X |
| 62184 | 5/1981 | Japan | 400/331.3 X |
| 14084 | 1/1982 | Japan | 400/236.2 X |
| 179680 | 10/1983 | Japan | 400/320 X |
| 71864 | 4/1984 | Japan | 400/120 X |
| 188484 | 10/1984 | Japan | 400/233 |
| 2135749 | 9/1984 | United Kingdom | 400/320 |

OTHER PUBLICATIONS

IBM Tech. Disc. Bulletin, "Ribbon Drive", Darwin, D. P., vol. 19, No. 4, Sep. 1976, pp. 1407–1408.

IBM Tech. Disc. Bulletin, "Ribbon Feed Mechanism", Breski et al., vol. 22, No. 7, Dec. 1979, pp. 2710–2711.

IBM Tech. Disc. Bulletin, "Apparatus with Selective Rotary and Translational Motion for Printer or Plotter", Kambic, vol. 20, No. 3, Aug. 1977, pp. 1103–1104.

*Primary Examiner*—Edgar S. Burr
*Assistant Examiner*—James R. McDaniel
*Attorney, Agent, or Firm*—Antonelli, Terry & Wands

[57] ABSTRACT

A thermal transfer printer wherein the carriage is equipped with the ribbon cassette and the thermal head and has a take-up shaft engageable with the take-up core of the ribbon cassette, and clutch means is provided between the motion converting means and the take-up shaft of the carriage, rotational force is transmitted from said motion converting means to the clutch means, and the clutch means cuts off the transmission of the rotational force to the take-up shaft. The rubbing transfer phenomenon does not occur, since, the ink ribbon starts to travel before the thermal head contacts the platen or after the thermal head separates the platen. It is possible to effect control such that no rubbing transfer occurs even when the thermal head is pressed against the platen to effect printing while the carriage is moving transversely at high speed.

13 Claims, 13 Drawing Figures

11
6
31
35
28
57a
36b
36
9
41
38
32
48
3
46

11
6
31
35
28
57a
36b
56
57
36
9
41
38
32
48
3
46

THERMAL TRANSFER PRINTER

This is a continuation of application Ser. No. 728,042, filed Apr. 29, 1985.

BACKGROUND OF THE INVENTION

The present invention relates to a thermal transfer printer, more particularly, it relates to a thermal transfer printer which has a thermal head and a ribbon cassette mounted on a carriage and is arranged such that, at the same time as the carriage moves transversely, an ink ribbon within the ribbon cassette is wound during printing.

A thermal transfer printer has heretofore been known in which the power to wind the ink ribbon is obtained from the power which drives the carriage, and a mechanism for cutting off the ribbon winding power is provided (Japanese Patent Laid-Open No. 179680/1983).

The thermal transfer printer described above is provided with a drive transmitting mechanism which allows the ribbon feed roller of the ribbon cassette to rotate in interlocked relation to the movement of the carriage, and a clutch for cutting off the engagement between the drive transmitting mechanism and the ribbon feed roller. The feed of the ink ribbon is effected by the cooperation between the ribbon feed roller and a press roller, and the travelling speed of the ink ribbon is maintained at a predeterminedly constant value.

The present inventors examined an arrangement in which the ribbon feed roller and the press roller are eliminated, and the ink ribbon is wound by the take-up core of the ribbon cassette. It has been found as the result of the examination that, as the ink ribbon is wound, the roll diameter of the ink ribbon being wound up on the take-up core increases, which fact involves an undesirable change in the travelling speed of the ink ribbon and consequently leads to the occurrence of a rubbing transfer phenomenon.

The rubbing transfer phenomenon is known such as following phenomenon. Even at the moment that the thermal head is pressed against the platen through the transfer printing paper, the thermal head and the ink ribbon are moving horizontally. In consequence, the ink ribbon moving at that speed rubs against the transfer printing paper before stopping. More specifically, the ink ribbon slides on the transfer printing paper until the speed of the ink ribbon is zero. While the ink ribbon is sliding, the ink on the ink ribbon is separated therefrom and undesirably adheres to the transfer printing paper, thus smearing the paper.

At the moment the thermal head presses the ink ribbon against the thermal printing paper to start printing, the ink ribbon is undesirably dragged in the direction of carriage motion together with the thermal head, whereby the ink ribbon is rubbed against the transfer printing paper, thus smearing the paper.

It is also possible to prevent the rubbing transfer phenomenon by transversely moving the carriage, that is, the thermal head, after the thermal head has been completely pressed against the transfer printing paper and the pressing force has thus been obtained. However, when it is necessary to skip during printing, that is, when it is necessary for the thermal head to be separated from the platen and against it again to the thermal printing paper, there is a need to suspend the transverse movement of the carriage every time skipping is required, and this greatly reduces printing speed. It is not therefore possible in practice to employ such a rubbing transfer prevention method.

SUMMARY OF THE INVENTION

One of the objects of the present invention is to provide a thermal transfer printer wherein no rubbing transfer phenomenon occurs.

Another object of the present invention is to provide a thermal transfer printer wherein the speed of motion of the carriage during the carriage return and/or the skipping can be increased, thereby the effective printing speed can be increased.

Another object of the present invention is to provide a thermal transfer printer wherein the ink ribbon can be wound in an aligned state.

According to the present invention, a thermal transfer printer comprises a: head pressing means for pressing a thermal head against a platen through a sheet of paper to be subjected to transfer printing; a ribbon cassette incorporating an ink ribbon and having a take-up core for winding up the ink ribbon; a carriage equipped with the ribbon cassette and the thermal head and having a take-up shaft engageable with the take-up core of the ribbon cassette; carriage driving means for transversely moving the carriage along the platen; motion converting means for converting the linear motion of the carriage into a rotational motion for winding up the ink ribbon; clutch means provided between the motion converting means and the take-up shaft of the carriage, a rotational force being transmitted from the motion converting means to the clutch means, and the clutch means cuts off the transmission of the rotational force to the take-up shaft; clutch driving means for driving the clutch means; and a controller for controlling the carriage driving means, the head pressing means and the clutch driving means.

A skip capability means has a capability to separate the thermal head from the platen when the thermal head is at positions where no printing is needed for the space of one line, while suspending the operation of winding the ink ribbon.

A motion converting means for converting the linear motion of the carriage into a rotational motion employs a combination of a belt and a pulley, a rack and a pinion, or a rollor and friction plate which comes in contact therewith. The motion converting means transfers driving power for transversing a carriage on a take-up shaft which also engages with a take-up core of a ribbon cassette.

As to both a head pressing means or a actuator used to drive a thermal head and a clutch driving means or a actuator used to control the travel of an ink ribbon, employment of solenoids is advantageous. A solenoid for the head pressing can be provided within the carriage, and the clutch driving means in relation to a take-up shaft of a carriage can be driven by another solenoid. The clutch driving means can be employed a combination of a permanent magnet and a coil.

A clutch means can employ a combination of a gear, which is engaged respectively with a take-up shaft of a carriage and motion converting means and a lever, which is engaged respectively with the gear and the clutch driving means, or a molded gear with permanent magnet, which is engaged respectively a take-up shaft of a carriage and the motion converting means.

In the present invention, tension acting on an ink ribbon is used for prevention of the rubbing transfer phenomenon, even when the transverse moving speed of a thermal head differs from the travelling speed of the ink ribbon. The tension acts on the ink ribbon in an opposite direction relative to the force which works to have the ink ribbon travel together with the thermal head. Thus, the magnitude of the pressing force on the ink ribbon, which works on the ink ribbon so as to make the thermal printing paper stationary with the ink ribbon, becomes less. Therefore no rubbing transfer phenomenon occurs.

For the prevention of the rubbing transfer phenonemenon, the ink ribbon is caused to start to travel at the moment, when immediately before the thermal head contacts to the platen or when immediately after the thermal head is separated from the platen. Also, the tension is caused to act on the ink ribbon in the opposite direction relative to the thermal head motion.

According to the present invention, the rubbing transfer phenomenon does not occur, since, the ink ribbon starts to travel before the thermal head contacts the platen or after the thermal head separates from the platen. It is possible to effect control such that no rubbing transfer occurs even when the. thermal head is pressed against the platen to effect printing while the carriage is moving transversely at high speed.

DETAILED DESCRIPTION OF THE PREFERRED EMBODIMENTS

Embodiments of the present invention will be described hereinunder.

Embodiment 1

Figure 1:
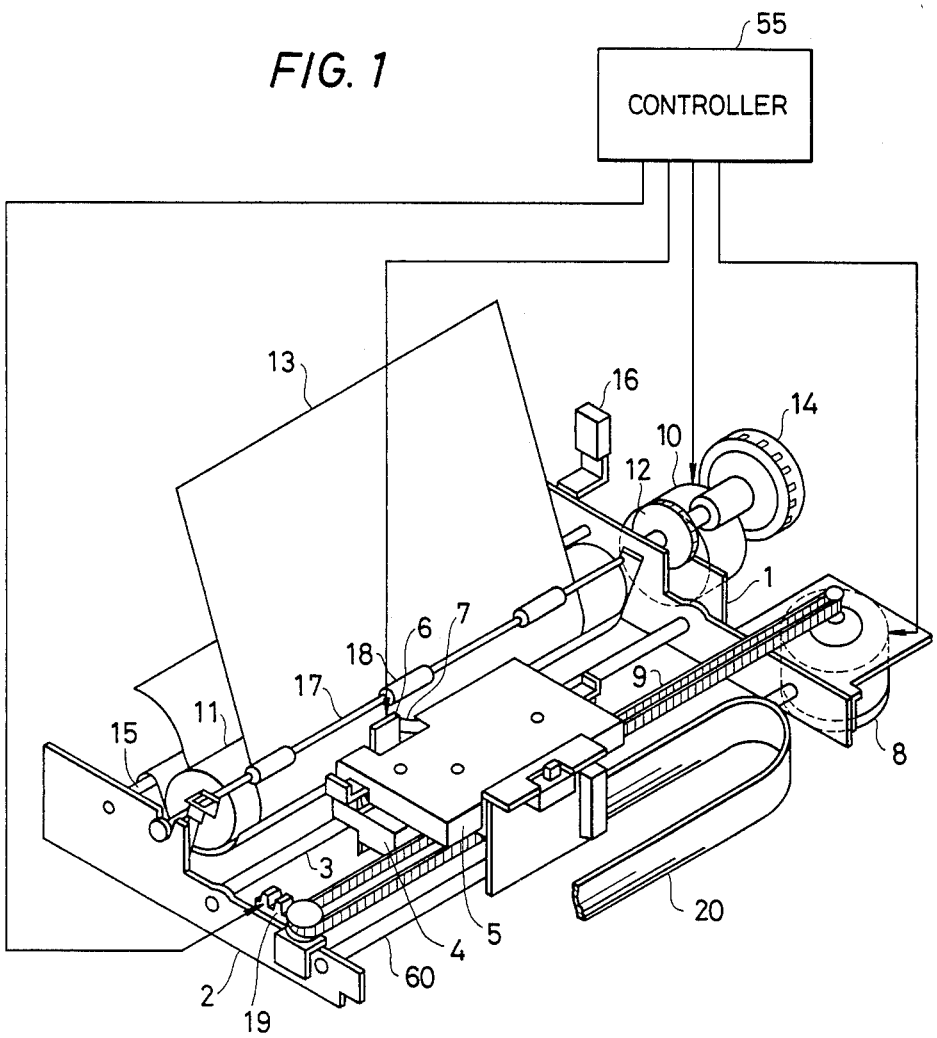
FIG. 1 is a view of the outer appearance of a thermal transfer printer which is one embodiment of the present invention.

FIG. 1 is a view of the outer appearance of an unidirectional printing type thermal transfer printer. A shaft 3 and a stay 60 are secured between side plates 1 and 2. A carriage 4 is slidably disposed on the shaft 3 and the stay 60. A ribbon cassette 5 and a thermal head 6 are detachably mounted on the carriage 4. An ink ribbon 7 is received inside the ribbon cassette 5.

The carriage 4 is arranged such as to be movable in the rightward and leftward directions by a carriage motor 8 through a timing belt 9. The printing is effected only when the carriage 4 is moved in the rightward direction. The ink ribbon 7 being wound when the carriage 4 is moved in the rightward direction and not wound when the carriage 4 is moved in the leftward direction.

A driving power is transmitted from a line feed motor 10 to a gear 12 tightly connected to a shaft of a platen 11, thereby feeding a transfer printing paper 13. It is also possible to feed the paper 13 in the same manner by turning a platen knob 14 by hand. A paper guide 15 is disposed in back portion of the platen 11. By moving a release lever 16 in the forward or backward direction, a paper press roller 18 which is slidably disposed on a shaft 17 is pressed against and separated from the surface of the transfer printing paper 13.

A home position sensor 19 is disposed on the side plate 2. A flat cable 20 mounted on a socket of the thermal head 6 is employed to supply current to the thermal head 6 and other electrical means. The carriage motor 8, the line feed motor 10, the thermal head 6 and the home position sensor 19 are controlled by a controller 55.

Figure 2:
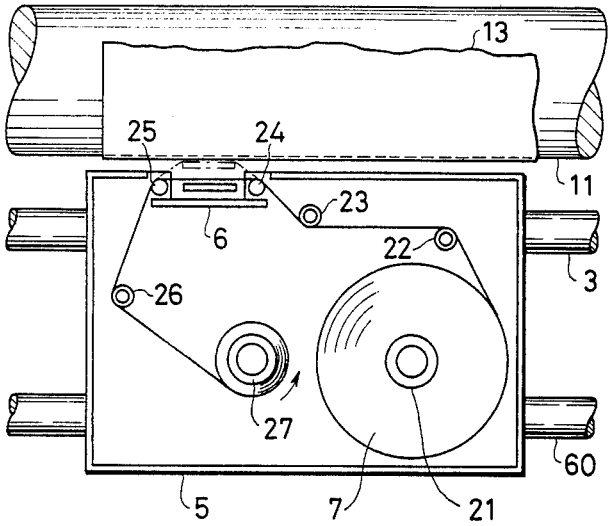
FIG. 2 is a plan view of the inside of a ribbon cassette mounted on a carriage.

FIG. 2 is a view of the internal structure of the ribbon cassette 5 mounted on the carriage 4, which shows the inside of the ribbon cassette 5 as viewed from the upper side thereof. The unused ink ribbon 7 wound on a supply core 21 is successively passed over guide rollers 22, 23, fixed guide pins 24, 25 and a guide roller 26. The ink ribbon 7 which has been subjected to transfer printing is wound on a take-up core 27. The take-up core 27 is arranged so as to engage a take-up shaft 28 which is provided on the carriage 4. (See FIG. 4).

FIG. 2 is a plan view of the carriage 4 in which the ribbon cassette 5 is removed. The carriage 4 is arranged such that the timing belt 9 adapted for moving the carriage 4 transversely is formed in a loop and engages pulley 35 provided inside the carriage 4, whereby the force for rotating the take-up shaft 28 is obtained simultaneously with the movement of the carriage 4.

Figure 3:
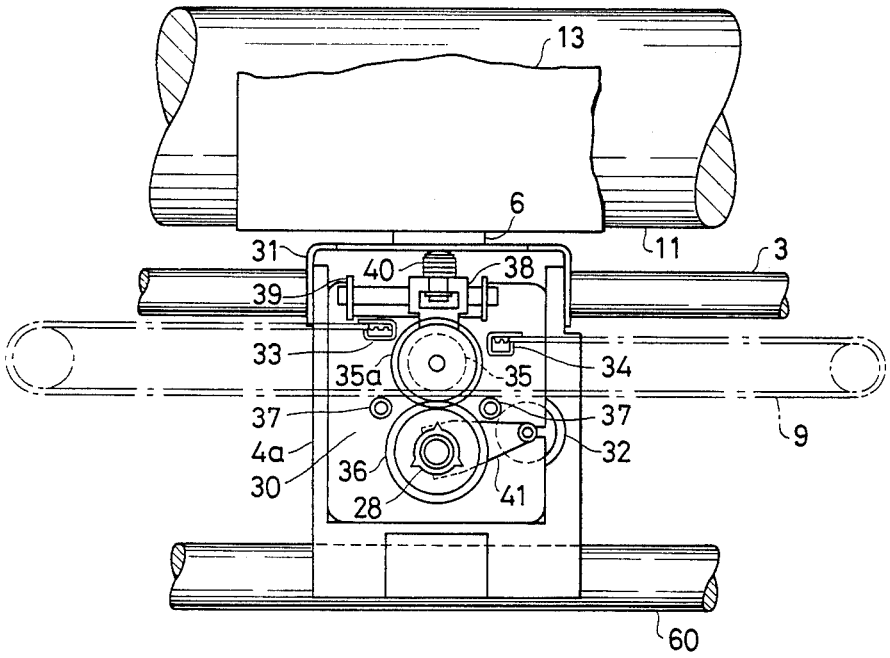
FIG. 3 is a plan view of a carriage.

FIG. 3 shows the printer in a printing state wherein the thermal head 6 is pressed against the transfer printing paper 13 on the platen 11.

A carriage casing **4*a* is slidably disposed on the shaft 3 and the stay 60. A carriage base plate 30 and a head support plate 31 are mounted respectively on the carriage casing 4*a*. A head pressing solenoid 46 (See FIG. 4) and a solenoid 32 to control clutch driving are mounted on the lower side of the carriage base plate 30**.

On the upper side of the carriage base plate 30 are mounted members 33 and 34 for fixing both ends of the timing belt 9, a pulley 35 which engages the timing belt 9 and converts the reciprocative linear motion of the timing belt 9 into a rotational motion, a take-up gear 36 which meshes with the toothed part **35*a* of the pulley 35 and to which the rotational force is transmitted from the pulley 35, and which has the function of cutting off the rotational force to the take-up shaft 28, and the take-up shaft 28 which engages the take-up core 27 inside the ribbon cassette 5**.

Belt press rollers 37 are adapted to press the timing belt 9 against the pulley 35. A solenoid lever 38 has one end thereof engaged with the plunger portion **46*a* of the head pressing solenoid 46 and is adapted to pivot about a support shaft 39, thereby pressing the thermal head 6 against the platen 11 through a compression spring 40 and the head support plate 31. A transmitting lever 41 transmits the driving force of the clutch driving control solenoid 32 to the take-up gear 36**.

The one end of the transmitting lever 41 is integrally press-fitted to a plunger portion **32*a* of the clutch driving control solenoid 32. The another end of the transmitting lever 41 is engaged with an annular portion 36*a* of the take-up gear 36. The transmitting lever 41 integrally with the take-up gear 36 is vertically moved along a take-up shaft support shaft 50. The take-up gear 36 rotates within the transmitting lever 41. The clutch means consists of the take-up gear 36 and the transmitting lever 41**.

Figure 4:
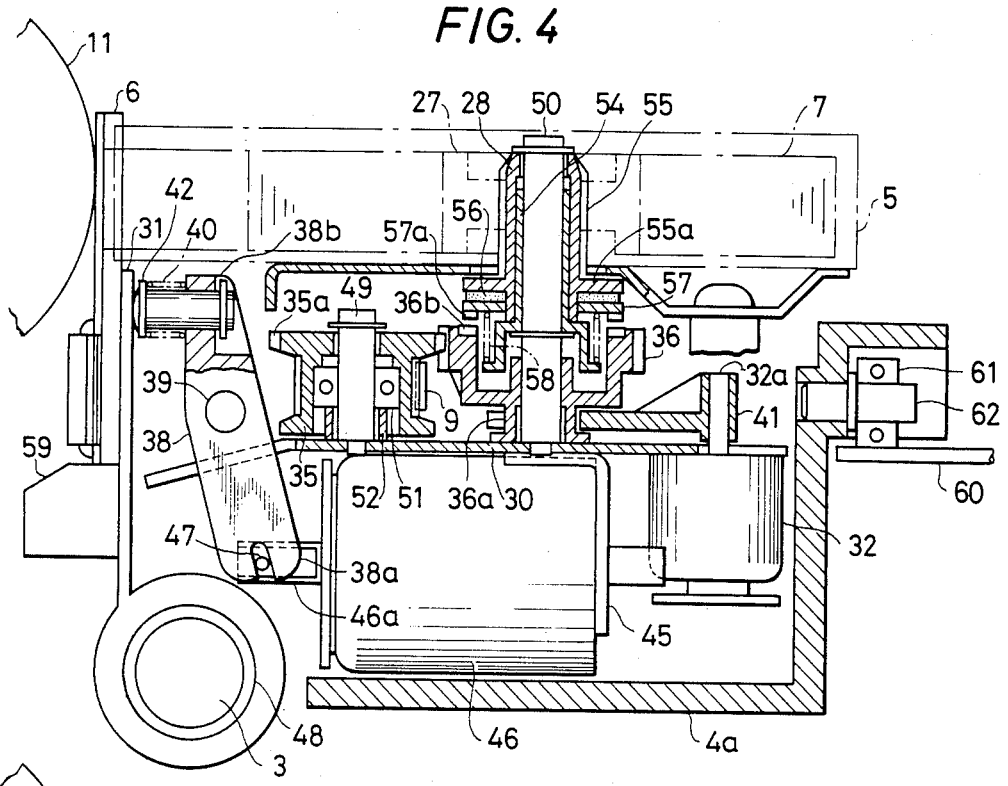
FIG. 4 is a sectional view of a carriage.

In FIG. 4, the head pressing solenoid 46 is mounted through a solenoid mounting member 45 on the lower side of the carriage base plate 30 which is mounted inside the carriage casing 4*a*. The plunger portion 46*a* of the head pressing solenoid 46 is provided with a connecting pin 47 which is engaged with one end portion 38*a* of the solenoid lever 38. A head mounting shaft 42 is mounted on the other end portion 38*b* of the solenoid lever 38 through the compression spring 40 in such a manner that the shaft 42 is slidable to a certain extent in its axial direction.

The head support plate 31 for supporting the thermal head 6 is disposed on the outer periphery of the shaft 3 in such a manner as to be pivotal about the outer periphery of a bearing 48 which is secured to the carriage casing 4*a*.

The arrangement is such that, when the head pressing solenoid 46 attracts the plunger portion 46*a*, the solenoid lever 38 pivots about the support shaft 39, thus causing the head mounting shaft 42 to press the thermal head 6 against the platen 11 through the head support plate 31.

A pulley support shaft 49 and the take-up shaft support shaft 50 are mounted respectively on the upperr side of the carriage base plate 30. The pulley 35 is mounted on the pulley support shaft 49 through a bearing 51 and engages the timing belt 9. A positioning collar 52 arranges bearing balls of the pulley 35 in a predetermined position.

The pulley 35 is integrally provided at its upper portion with a toothed part 35*a*. The take-up shaft support shaft 50 is provided at its lower portion with the take-up gear 36 which meshes with the toothed part 35*a* of the pulley 35 in such a manner that the take-up gear 36 can rotate as well as slide vertically, that is, in the axial direction of the support shaft 50.

The take-up gear 36 is provided at its lower portion with an engagement part 36*a* which engages the transmitting lever 41, the latter being rigidly press-fitted on the plunger portion 32*a* of the clutch driving control solenoid 32. The take-up gear 36 is provided at its upper portion with a gear or pawl part 36*b* which is meshed with a gear or pawl part 57*a* provided on the take-up shaft 28 by the upward movement of the take-up gear 36 itself.

The structure of the take-up shaft 28 will now be described.

A first take-up shaft 54 is inserted in such a manner as to be rotatable around the take-up shaft support shaft 50 which is mounted integrally to the carriage base plate 30. A second take-up shaft 55 having three pawl parts for engagement with the take-up core 27 is integrally press-fitted and secured on the outer periphery of the first take-up shaft 54.

A friction plate 57 which is provided on its lower side with the gear or pawl part 57*a* is mounted on the flange part in the lower portion of the second take-up shaft 55 in such a manner that the friction plate 57 is rotatable around the outer periphery of the take-up shaft 55. The friction plate 57 is pressed toward a friction member 56 by the action of a spring 58.

The downward gear or pawl part 57*a* of the friction plate 57 is vertically engaged with the upward gear or pawl part 36*a* of the take-up gear 36. As the gear or pawl part 36*a* of the take-up gear 36 is vertically provided, the the winding force of the clutch means can be cut down quickly by using the respective weights of takeup gear 36 and the plunger portion 32*a* of the clutch driving control solenoid 32.

The take-up shaft 28 comprises the first take-up shaft 54, the second take-up shaft 55, the friction member 56, the friction plate 57 and the spring 58.

A connector 59 connects the flat cable 20 to the thermal head 6. A roller 61 enables the carriage 4 to slide smoothly on the stay 60. A support shaft 62 supports the roller 61.

The operation of the printer arranged as above will be described hereinunder.

Figure 5:
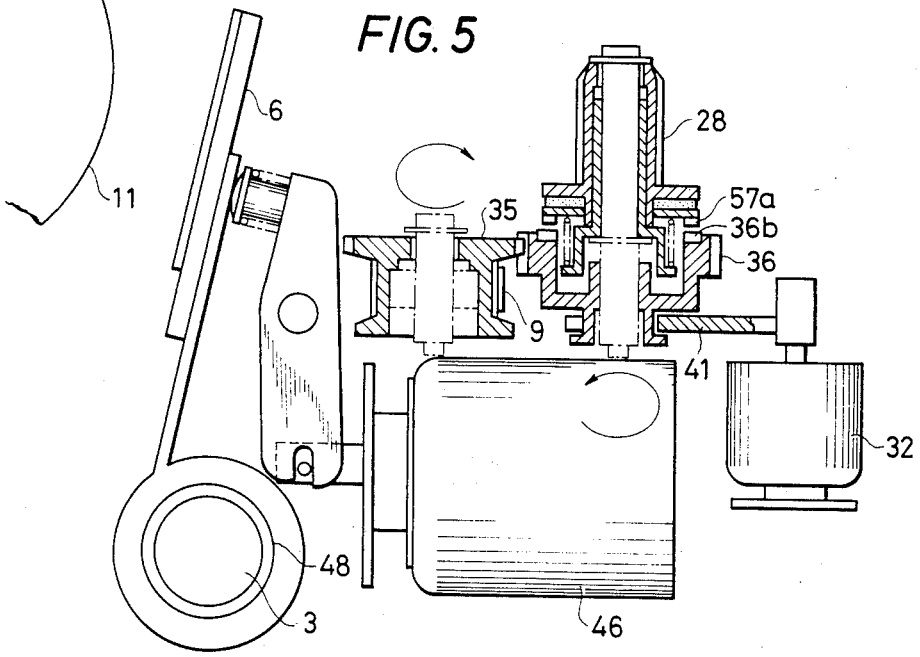
FIGS. 5, 6 and 7 are views employed to describe the operation of the carriage shown in FIG. 1.

Description will be made of the operation of the carriage in a state wherein return or skipping is being conducted. In FIG. 5, neither the head pressing solenoid 46 nor the clutch driving control solenoid 32 is energized; therefore, no attraction force is generated.

The thermal head 6 is not pressed against the platen 11 and the gear or pawl portion 36*b* of the take-up gear 36 does not engage the tooth or pawl portion 57*a* of the take-up shaft 28. Consequently, the rotational force which has been transmitted from the timing belt 9 to the pulley 35 is further transmitted to the take-up gear 36 but is not transmitted to the take-up shaft 28. In other words, the pulley 35 and the take-up gear 36 are simply idling and do not effect the winding of the ink ribbon 7.

The condition immediately before printing is started, in other words, the condition immediately before the thermal head 6 press against the platen 11, will be described.

When printing starts, the clutch driving control solenoid 32 is energized before the head pressing solenoid 46 by the controller 55, so as to press the thermal head 6 against the platen 11.

Figure 6:
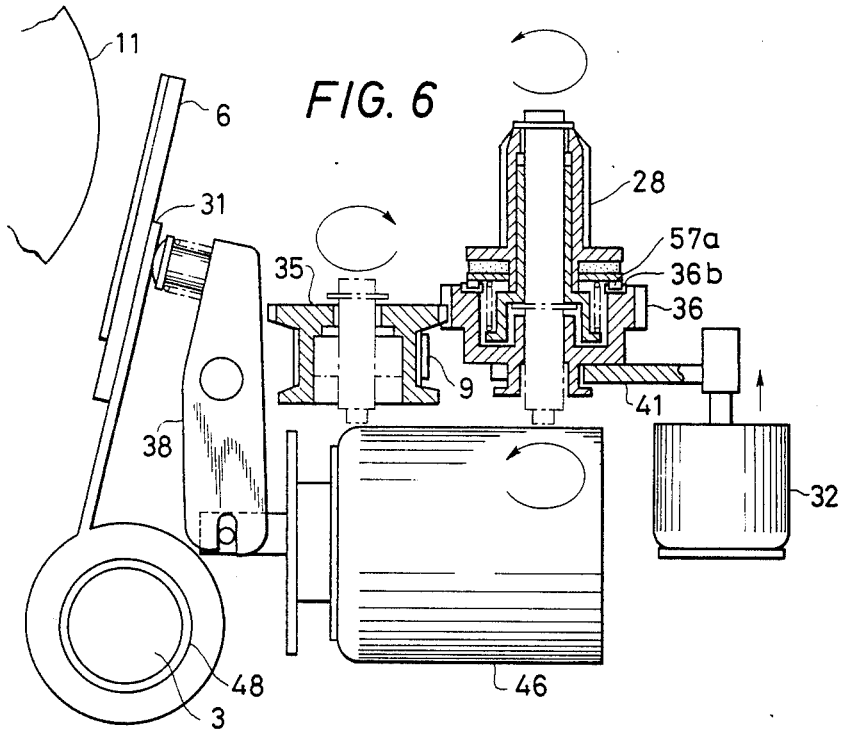

For this reason, the take-up gear 36 is pushed up by the transmitting lever 41 in the axial direction thereof shown in FIG. 6. Consequently, the tooth or pawl part 36*b* of the take-up gear 36 engages the tooth or pawl part 57*a* of the take-up shaft 28, which allows the rotational force of the pulley 35, which winds the ink ribbon 7, to be transmitted to the take-up shaft 28, thus causing the take-up shaft 28 to wind the ink ribbon 7. In other words, the ink ribbon 7 starts to travel before the thermal head 6 contacts the platen 11. Accordingly, it is possible to prevent the rubbing transfer phenomenon.

The occurrence of the rubbing transfer phenomenon may be prevented will now be explained.

The ink ribbon 7 is prevented from being dragged in the transverse direction of movement of the thermal head 6 at the moment the thermal head 6 is pressed against the transfer printing paper 13.

Figure 8:
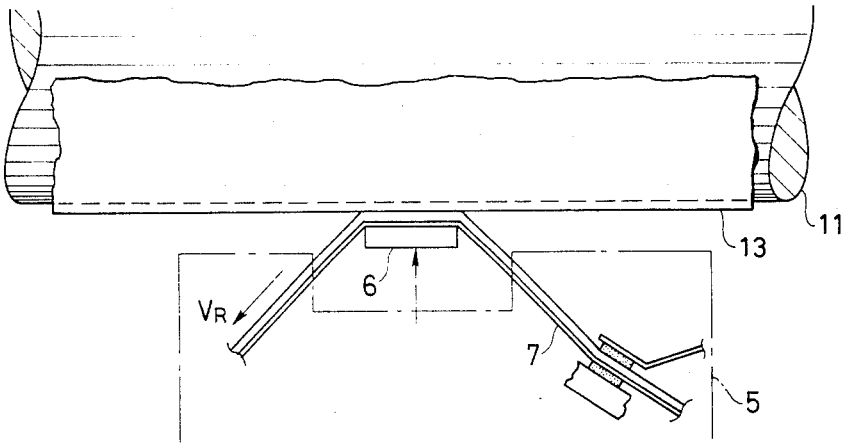
FIG. 8 is a view employed to describe means for the prevention of the rubbing transfer phenomenon.

In FIG. 8, the ink ribbon 7 have already started to travel in the opposite direction relative to the thermal head direction of motion, that is, the direction of the arrow $V_R$, before the thermal head 6 is pressed against the transfer printing paper 13.

Even at the moment when the thermal head 6 is pressed against the transfer printing paper 13, there is no possibility of the ink ribbon 7 being dragged in the thermal head direction of motion such as to cause the rubbing transfer phenomenon to occur.

The condition immediately after printing has been completed, in other words, the condition immediately after the thermal head 6 has been separated from the platen 11, will be described hereinunder.

When printing is complete, control is effected such that the energization of the clutch driving control solenoid 32 is cut off after the energization of the head pressing solenoid 46 is cut off by the controller 55. This precludes the possibility of the ink ribbon 7 being dragged by the thermal head 6, since the ink ribbon 7 is travelling in the opposite direction relative to the direction in which the thermal head 6 moves transversely at the moment when the thermal head 6 is separated from the platen 11 by cutting off of the energization of the head pressing solenoid 46.

The stationary force of the thermal head 6 against the ink ribbon 7 can become small according to lesser head pressing, the tension on the ink ribbon 7 generally remains in a balanced condition. No sliding transfer phenomenon occurs, accordingly no rubbing transfer phenomenon occurs. (See FIGS. 6 and 8).

Since the thermal head 6 returns, the ink ribbon 7 sags by an amount corresponding to the degree by which the thermal head 6 returns. However, at the moment the thermal head 6 returns, the ink ribbon 7 is travelling; therefore, the ink ribbon 7 is immediately pulled taut. Accordingly, the ink ribbon 7 is not offset in the vertical direction and it is possible to wind the ink ribbon 7 in an aligned state.

Figure 7:
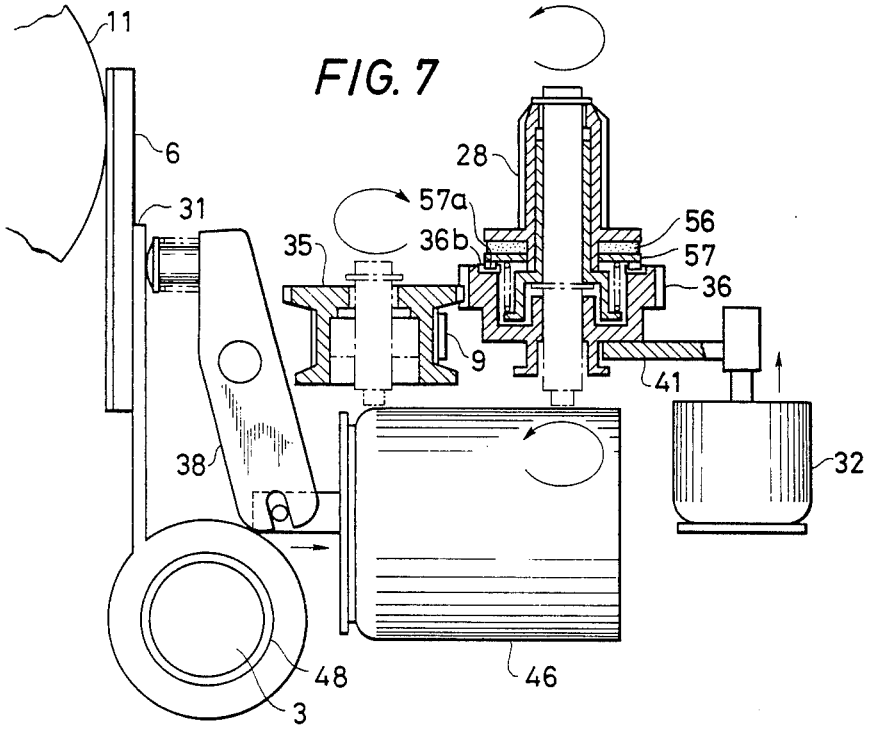

FIG. 7 shows the printer in a normal printing state. In this case, after the ink ribbon 7 has travelled, the head pressing solenoid 46 is actuated such as to pivot the solenoid lever 38, thus causing the thermal head 6 to be pressed against the platen 11 through the head support plate 31.

The ink ribbon 7 which has been subjected to printing and is discharged by the transverse movement of the thermal head 6 is wound at a constant take-up torque by the action of the take-up shaft 28 and the sliding between the friction member 56 and the friction plate 57 which are provided integrally on the take-up shaft 28.

According to the above embodiment, the rubbing transfer phenomenon does not occur, since, when printing starts, the ink ribbon 7 starts to travel before the thermal head 6 contacts the platen 11 or when the condition immediately after printing has completed, the thermal head 6 separates from the platen 11. More specifically, it is possible to effect control such that no rubbing transfer occurs even when the thermal head 6 is pressed against the platen 11 to effect printing while the carriage 4 is moving transversely at high speed. It is therefore possible to increase the printing speed and to improve printing quality.

It is possible to prevent the occurrence of the rubbing transfer phenomenon in the above embodiment because of the following reasons. Namely, the head pressing solenoid 46 used to drive the thermal head 6 and the clutch driving solenoid 32 used to control the travel of the ink ribbon 7 are completely separated from each other. Moreover, the two solenoides 46, 32 are controlled by offsetting the respective timing of voltage applied to each solenoid 46 or 32. And further the ink ribbon 7 is caused to start immediately before the thermal head 7 is pressed against the platen 11 or immediately after the thermal head 7 is separated from the platen 11 during the transverse movement of the carriage 4.

The above clutch means, which comprises the take-up gear 36 and the transmitting lever 41, is controlled in such a manner that the transmission of power to drive the take-up shaft 28 from the carriage 4 is cut off during skipping or return operations, and is coupled to the take-up shaft 28 only during printing. By so doing, there is no need to provide power to wind the ink ribbon 7 during operations other than printing; therefore, the load imposed on the power source advantageously becomes extremely small as compared with that during printing.

It is possible for the power employed to wind the ink ribbon 7 during printing to be used as the power to move the carriage 4 when return and skipping, which involve a relatively small load. Thus, it is possible to quicken the carriage movement and consequently increase the effective printing speed.

As the arrangement is such that the solenoid 46 for pressing the thermal head 6 is provided inside the carriage 4, and the clutch means, which is engaged with take-up shaft 28, is driven by another clutch driving solenoid 32, the size of the carriage 4 can be reduced, the speed of response can be increased, and the control circuit can be simplified.

It is possible for ribbon winding to be effected as desired and in non-interlocked relation to the carriage 4 moving operation by virtue of the clutch means. It is therefore also possible to skip.

There is no sagging of the ink ribbon 7 due to the operation of the thermal head 6, it becomes possible to wind the ink ribbon 7 in an aligned state.

Embodiment 2

In this embodiment, in place of the clutch driving control solenoid 32 employed in the above Embodiment 1, a combination of a permanent magnet and a coil is employed, and a magnetic repulsion force which is generated in the permanent magnet by supplying current to the coil is utilized to control clutch driving.

Figure 9:
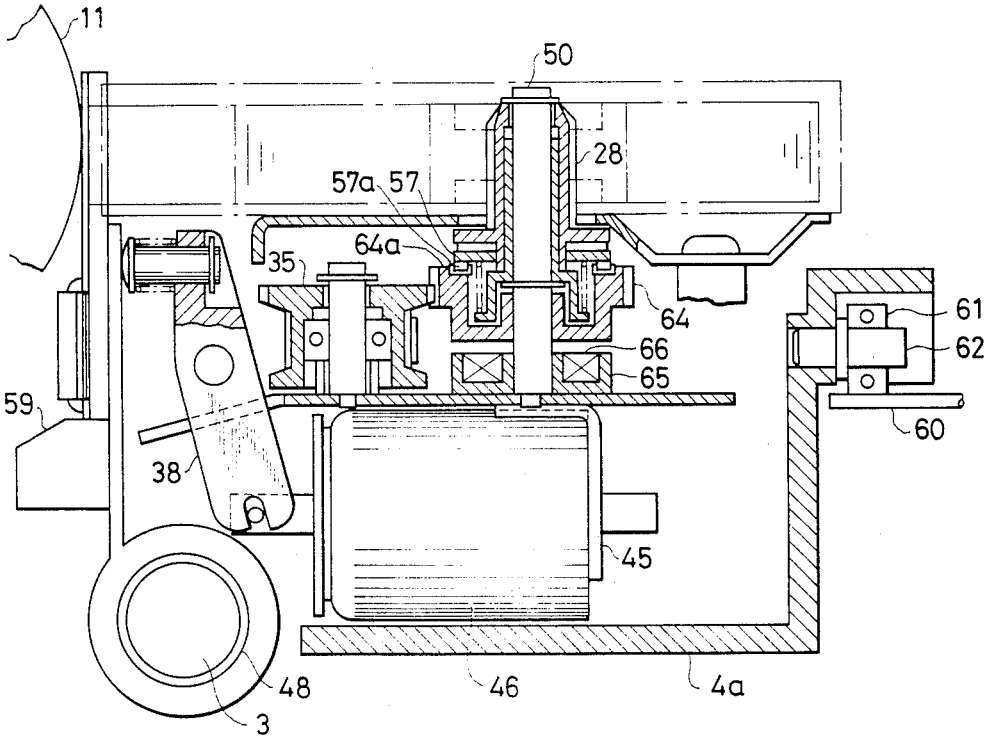
FIG. 9 is a sectional view of a carriage showing another embodiment of the present invention.

The arrangement of this embodiment will be described with reference to FIG. 9. Note that no description is given of those parts which are the same as those of the Embodiment 1 shown in FIG. 4. The clutch driving control solenoid 32 and the transmitting lever 41 attached thereto which are shown in FIG. 4 are removed, and in this embodiment a take-up gear 64 is formed of a molded permanent magnet such as a molded plastic magnet.

The take-up gear 64 is mounted on the take-up shaft support shaft 50 such as to be rotatable around the take-up shaft support shaft 50 as well as slidable in its axial direction in a manner similar to that of the above embodiment 1. In addition, a bobbin 65 is provided at the position where it opposes the lower side of the take-up gear 64 in such a manner that the bobbin 65 is located around the take-up shaft support shaft 50. A coil 66 is disposed inside the bobbin 65.

The direction of the current to be supplied to the coil 66 by the controller 55 and the magnetic poles of the permanent magnet are set such that a magnetic repulsion force is generated such as to act between the take-up gear 64 and the coil 66 by supplying current to the coil 66.

The arrangement is such that, when the take-up gear 64 is floated by the magnetic repulsion force, the tooth or pawl part **64*a* provided on the take-up gear 64 engages the tooth or pawl part of the friction plate 57; when the magnetic repulsion force is removed, that is when the supply of current to the coil 66 is cut off, the take-up gear 64** drops such as to release the above-described engagement.

(In the condition wherein return or skipping is being conduced.)

Figure 10:
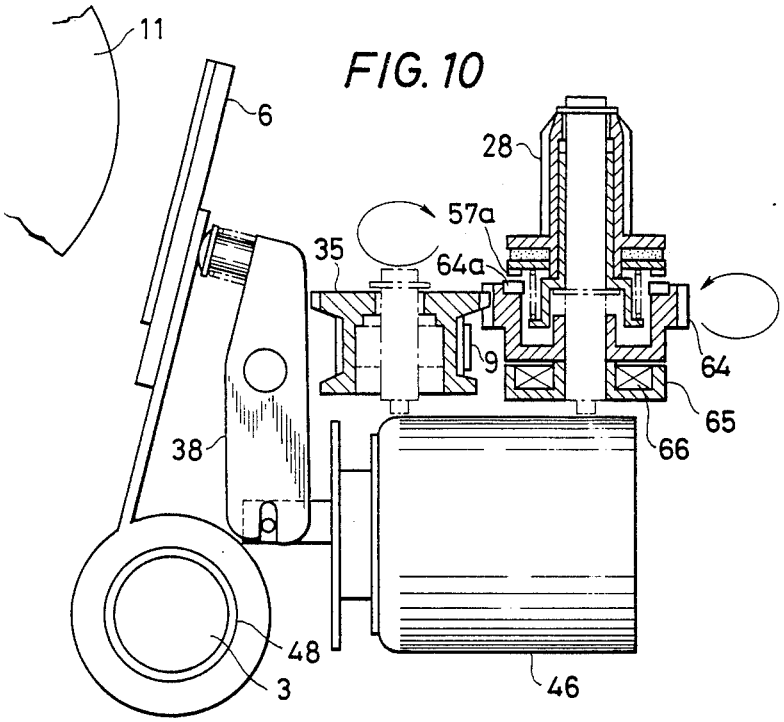
FIGS. 10, 11 and 12 are views employed to describe the operation of the carriage shown in FIG. 9.

FIG. 10 shows the printer in a non-printing state. Under this state, neither the head pressing solenoid 46 nor the coil 66 is energized. For this reason, the thermal head 6 is not pressed against the platen 11 and no magnetic repulsion force is generated between the take-up gear 64 and the take-up shaft 28. Consequently, neither engages the other, and the pulley 35 and the take-up gear 64 are simply idling and do not wind the ink ribbon 7.

Figure 11:
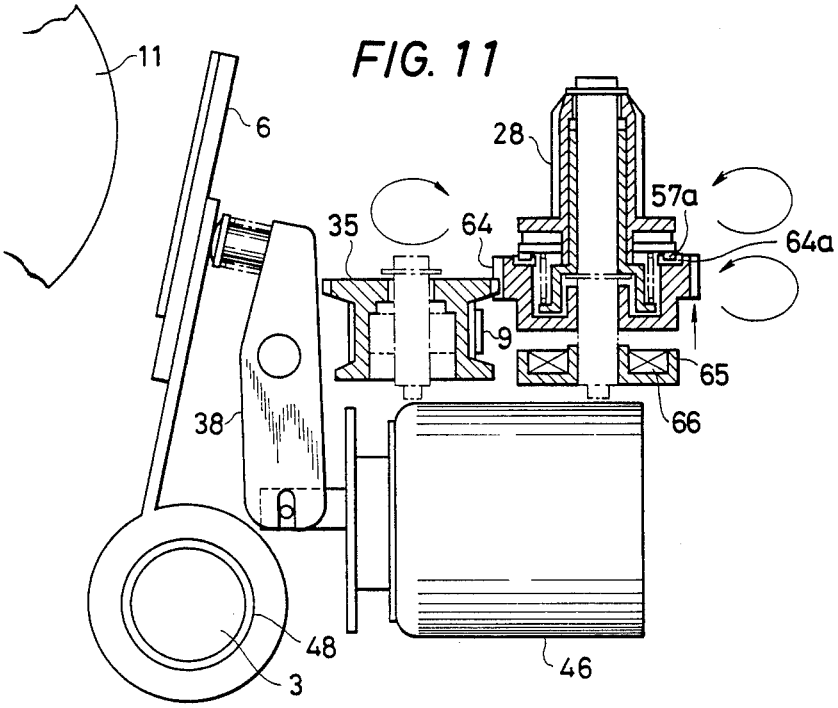

When printing starts, the energization of the coil 66 is initiated by the controller 55 before the energization of the head pressing solenoid 46. In consequence, the ink ribbon 7 starts to travel before the thermal head 7 is pressed against the platen 11. Accordingly, it is possible to prevent the rubbing transfer phenomenon. (See FIG. 11).

In this case, control is effected by the controller 55 such that the energization of the coil 66 is cut off after the energization of the head pressing solenoid 46 is cut off. (See FIG. 11).

Figure 12:
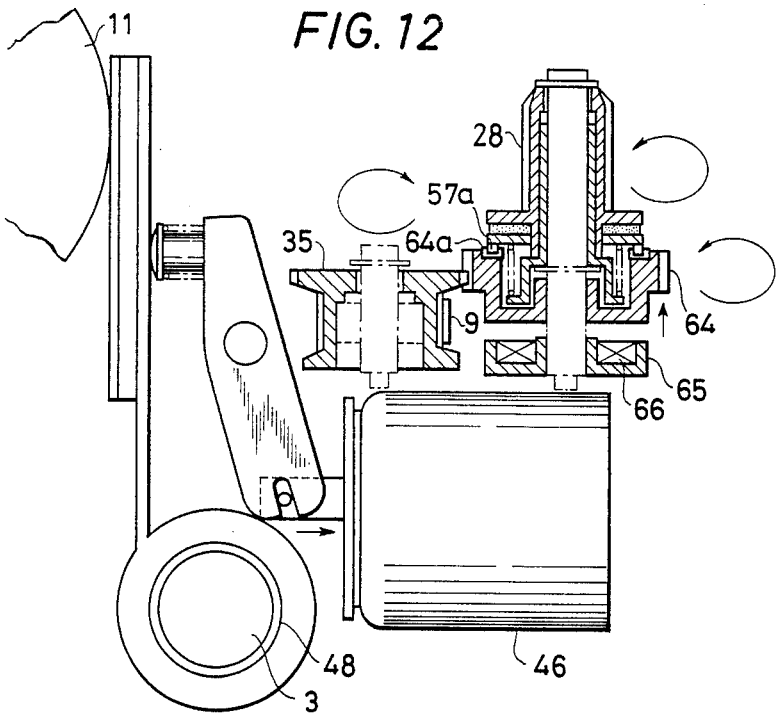

FIG. 12 shows the printer in a normal printing state in which both the head pressing solenoid 46 and the coil 66 are energized by the controller 55 so that printing is effected and the ink ribbon 7 is wound. (Confer FIG. 12).

According to the this embodiment , it is possible to eliminate the clutch driving control solenoid and the transmitting lever. Since there is no need to provide any space for mounting the clutch driving solenoid and the transmitting lever, it is advantageously possible to reduce the size of the carriage 4.

Embodiment 3

In the carriage shown in embodiments 1 and 2, a single timing belt 9 is employed to move the carriage 4 transversely and to transmit the power to the take-up shaft 28. In this embodiment , in addition to the timing belt for moving the carriage transversely, a means is provided for rotating the take-up shaft in relation to the transverse movement of the carriage 4.

Figure 13:
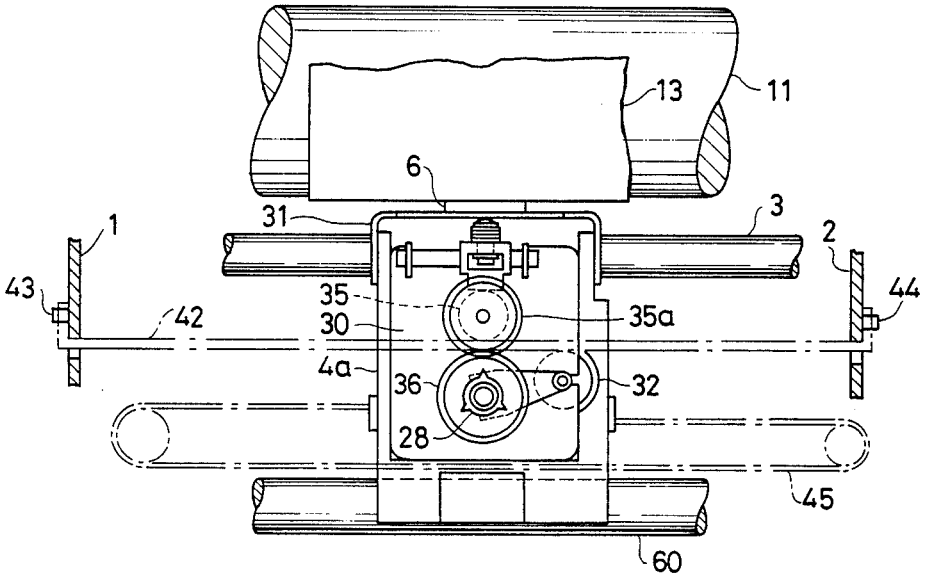
FIG. 13 is a plan view of a carriage showing another embodiment of the present invention.

In FIG. 13, in addition to the timing belt 45 for the transverse movement of the carriage 4, a fixed belt 42 is provided which is employed to convert the transverse movement of the carriage 4 into a rotational force. The ends of the fixed belt 42 are secured respectively to the side plates 1 and 2 by fixing members 43 and 44. The fixed belt 42 is pressed against the pulley 35. The timing belt 45 is secured at both its ends to the carriage casing 4a and is formed in a loop. This timing belt 45 is, however, adapted to effect only the trasverse movement of the carriage 4.

What is claimed is:

1. A thermal transfer printer comprising:

head pressing means for pressing a thermal head against a platen through a sheet of a paper to be subjected to transfer printing;

a ribbon cassette incorporating an ink ribbon and having a take-up core for winding up the ink ribbon;

a carriage equipped with said ribbon cassette and the thermal head and having a take-up shaft engageable with the take-up core of said ribbon cassette;

carriage driving means for transversely moving said carriage along the platen;

motion converting means for converting the linear motion of said carriage into a rotational motion for winding up the ink ribbon on said take-up core during printing;

controller means for controlling said carriage driving means and said head pressing means;

clutch means provided between said motion converting means and the take-up shaft of said carriage, a rotational force being transmitted from said motion converting means to said clutch means, and said clutch means cutting off the transmission of the rotational force to the take-up shaft of said carriage;

clutch driving means for driving said clutch means so as to wind up the ink ribbon, said clutch driving means being controlled through said controller means;

head press driving means for driving said head pressing means, said head press driving means being controlled through said controller means; and said clutch driving means and said head press driving means are independent of each other, whereby said clutch driving means are independently controlled through said controller means.

2. A thermal transfer printer comprising:

head pressing means for pressing a thermal head against a platen through a sheet of paper to be subjected to transfer printing;

a ribbon cassette incorporating an ink ribbon and having a take-up core for winding up the ink ribbon;

a carriage equipped with said ribbon cassette and the thermal head and having a take-up shaft engageable with the take-up core of said ribbon cassette;

carriage driving means for transversely moving said carriage along the platen;

motion converting means for converting the linear motion of said carriage into a rotational motion for winding up the ink ribbon on said take-up core during printing;

controller means for controlling said carriage driving means and said head pressing means;

clutch means provided between said motion converting means and the take-up shaft of said carriage, a rotational force being transmitted from said motion converting means to said clutch means, and said clutch means cutting off the transmission of the rotational force to the take-up shaft of said carriage;

clutch driving means for driving said clutch means so as to wind up the ink ribbon, said clutch driving means being controlled through said controller means;

head press driving means for driving said head pressing means, said head press driving means being controlled through said controller means;

wherein said clutch driving means and said head press driving means are independent of each other, whereby said clutch driving means and said head press driving means are independently controlled through said controller means; and wherein the take-up shaft of said carriage includes an engagement means engageable with the take-up core of said ribbon cassette with said clutch means.

3. A thermal transfer printer according to claim 2, wherein said clutch means includes a combination of one of a gear having an engagement portion engageable with the take-up shaft of said carriage and an engagement portion engageable with said motion converting means; and a lever having at one of its ends an engagement portion engageable with the gear and at the other end a press-fit portion which is press-fitted on a shaft of said clutch driving means, for a gear formed of a permanent magnet by molding and having an engagement portion engagement with the take-up shaft of said carriage and an engagement portion engageable with said motion converting means.

4. A thermal transfer printer according to claim 2, wherein said clutch driving means includes one of a solenoid or a combination of a magnet and a coil.

5. A thermal transfer printer comprising:

head pressing means for pressing a thermal head against a platen through a sheet of paper to be subjected to transfer printing;

a ribbon cassette incorporating an ink ribbon and having a take-up core for winding up the ink ribbon;

a carriage equipped with said ribbon cassette and the thermal head and having a take-up shaft engageable with the take-up core of said ribbon cassette;

carriage driving means for transversely moving said carriage along the platen;

motion converting means for converting the linear motion of said carriage into a rotational motion for winding up the ink ribbon;

controller means for controlling said carriage driving means and said head pressing means;

clutch means provided between said motion converting means and the take-up shaft of said carriage, a rotational force being transmitted from said motion converting means to said clutch means, and said clutch means cutting off the transmission of the rotational force to the take-up shaft of said carriage; and clutch driving means for driving said clutch means, said clutch driving means being controlled through said controller means, wherein the take-up shaft of said carriage includes a first take-up shaft rotatably provided on a support shaft mounted on said carriage; a second take-up shaft integrally provided on the outer periphery of the first take-up shaft and having an engagement portion engageable with the take-up core of said ribbon cassette; and a friction plate rotatably mounted on the second take-up shaft and having an engagement portion engageable with said clutch means.

6. A thermal transfer printer according to claim 5, wherein the take-up shaft of said carriage further includes: the second take-up shaft having a friction member; and a spring provided between the first take-up shaft and the friction plate such as to press the friction plate againstj the friction member of the second take-up shaft.

7. A thermal transfer printer according to claim 5, wherein the friction plate provided on the second take-up shaft of said carriage has a downward engagement portion, and said clutch means has an upward engagement portion, both the engagement portions being engageable with each other in the vertical direction.

8. A thermal transfer printer comprising:

head pressing means for pressing a thermal head against a platen through a sheet of paper to be subjected to transfer printing;

a ribbon cassette incorporating an ink ribbon and having a take-up core for winding up the ink ribbon;

a carriage equipped with said ribbon cassette and the thermal head and having a take-up shaft engageable with the take-up core of said ribbon cassette;

carriage driving means for transversely moving said carriage along the platen;

motion converting means for converting the linear motion of said carriage into a rotational motion for winding up the ink ribbon on said take-up core during printing;

controller means for controlling said carriage driving means and said head pressing means;

clutch means provided between said motion converting means and the take-up shaft of said carriage, a rotational force being transmitted from said motion converting means to said clutch menas, and said clutch means cutting off the transmission of the rotational force to the take-up shaft of said carriage;

clutch driving means for driving said clutch means so as to wind up the ink ribbon, said clutch driving means being controlled through said controller means;

head press driving means for driving said head pressing means, said head press driving means being controlled through said controller means; and wherein a contol is effected by said controller means such that during a return or a skipping operation, said clutch driving means is not actuated, and the engagement between said clutch means and the take-up shaft of said carriage is released.

9. A thermal transfer printer according to claim 1, wherein a control is effected by said controller such that, immediately before printing operation is started, said head pressing means is not actuated, and before the thermal head is pressed against the platen, said clutch driving means is actuated such as to engage said clutch means and the take-up shaft of said carriage with each other, thereby allowing the ink ribbon to travel in the opposite direction relative to the moving direction of the thermal head.

10. A thermal transfer printer according to claim 11, wherein control is effected by said controller such that, simultaneously a supply current to the thermal head is completed, the operation of said head pressing means is cancelled, even after the thermal head has been separated from the platen, and said clutch driving means is cancelled after the operation of said clutch driving means is maintained during a fixed period of time said clutch driving means is acutated so as to engage said clutch means and the take-up shaft of said carriage with each other, thereby allowing the ink ribbon to travel in the opposite direction relative to the moving direction of the thermal head.

11. A thermal transfer printer according to claim 8 wherein a control is effected by said controller such that, immediately before printing operation is started, said head pressing means is not actuated, and before the thermal head is pressed against the platen, said clutch driving means is actuated such as to engage said clutch means and the take-up shaft of said carriage with each other, thereby allowing the ink ribbon to travel in the opposite direction relative to the moving direction of the thermal head.

12. A thermal transfer printer according to claim 8, wherein control is effected by said controller such that, simultaneously a supply current to the thermal head is completed, the operation of said head pressing means is cancelled, even after the thermal head has been separated from the platen, and said clutch driving means is cancelled after the operation of said clutch driving means is maintained during a fixed period of time said clutch driving means is actuated such as to engage said clutch means and the take-up shaft of said carriage with each other, thereby the ink ribbon begins to travel prior to a contact between the thermal head and the platen and allowing the ink ribbon to travel in the opposite direction relative to the moving direction of the thermal head.

13. A thermal transfer printer according to claim 13, wherein the take-up shaft of said carriage includes a first take-up shaft rotatably mounted on said carriage; a second take-up shaft provided on the first take-up shaft and having an engagement portion engageable with the take-up core of said ribbon cassette; and a friction plate rotatably having an engagement portion engageable with said clutch means.

* * * * *